US009290995B2

(12) United States Patent
Boone et al.

(10) Patent No.: US 9,290,995 B2
(45) Date of Patent: Mar. 22, 2016

(54) DRILL STRING OSCILLATION METHODS

(71) Applicant: Canrig Drilling Technology Ltd., Houston, TX (US)

(72) Inventors: Scott G. Boone, Houston, TX (US); Colin Gillan, Houston, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 456 days.

(21) Appl. No.: 13/708,255

(22) Filed: Dec. 7, 2012

(65) Prior Publication Data

US 2014/0158428 A1 Jun. 12, 2014

(51) Int. Cl.

| | |
|---|---|
| ***E21B 7/24*** | (2006.01) |
| ***E21B 44/00*** | (2006.01) |
| *E21B 3/02* | (2006.01) |

(52) U.S. Cl.

CPC . *E21B 7/24* (2013.01); *E21B 44/00* (2013.01); *E21B 3/02* (2013.01)

(58) Field of Classification Search

CPC ..... E21B 3/025; E21B 3/03; E21B 3/035; E21B 31/005; E21B 7/24; E21B 44/00; E21B 3/02

See application file for complete search history.

(56) References Cited

U.S. PATENT DOCUMENTS

| | | | |
|---|---|---|---|
| 1,891,329 | A | 12/1932 | Le Compte et al. |
| 2,005,889 | A | 6/1935 | Dillon et al. |
| 2,724,574 | A | 11/1955 | Ledgerwood, Jr. |
| 3,223,183 | A | 12/1965 | Varney |
| 3,265,359 | A | 8/1966 | Bowden |
| 3,407,886 | A | 10/1968 | Bennett |
| 3,550,697 | A | 12/1970 | Hobhouse |
| 3,658,138 | A | 4/1972 | Gosselin |
| 4,128,888 | A | 12/1978 | Sheldon et al. |
| 4,146,347 | A | 3/1979 | Woods |
| 4,165,789 | A | 8/1979 | Rogers |
| 4,174,577 | A | 11/1979 | Lewis |
| 4,187,546 | A | 2/1980 | Heffernan et al. |
| 4,195,699 | A | 4/1980 | Rogers et al. |
| 4,281,723 | A | 8/1981 | Edmond et al. |

(Continued)

FOREIGN PATENT DOCUMENTS

| | | |
|---|---|---|
| EP | 0774563 B1 | 7/2002 |
| RU | 2208153 C2 | 7/2003 |

(Continued)

OTHER PUBLICATIONS

US 6,223,498, 05/2001, King et al. (withdrawn).

(Continued)

*Primary Examiner* — Blake Michener
*Assistant Examiner* — Christopher Sebesta
(74) *Attorney, Agent, or Firm* — Haynes and Boone, LLP

(57) ABSTRACT

A method includes oscillating, with a first acceleration profile, at least a portion of a drill string using a top drive at least indirectly coupled to the drill string and includes oscillating, with a second acceleration profile different from the first acceleration profile, at least a portion of the drill string using the top drive. The method also includes oscillating, with a third acceleration profile, at least a portion of the drill string using the top drive, wherein the third acceleration profile is optimized based on feedback associated with the oscillation with the first acceleration profile and feedback associated with the oscillation with the second acceleration profile.

18 Claims, 5 Drawing Sheets

(56) References Cited

U.S. PATENT DOCUMENTS

| | | | | |
|---|---|---|---|---|
| 4,354,233 | A | 10/1982 | Zhukovsky et al. | |
| 4,453,603 | A | 6/1984 | Voss et al. | |
| 4,492,276 | A | 1/1985 | Kamp | |
| 4,535,972 | A | 8/1985 | Millheim et al. | |
| 4,601,353 | A | 7/1986 | Schuh et al. | |
| 4,662,608 | A | 5/1987 | Ball | |
| 4,739,325 | A | 4/1988 | MacLeod | |
| 4,794,534 | A | 12/1988 | Millheim | |
| 4,854,397 | A | 8/1989 | Warren et al. | |
| 4,958,125 | A | 9/1990 | Jardine et al. | |
| 5,042,597 | A | 8/1991 | Rehm et al. | |
| 5,103,919 | A | 4/1992 | Warren et al. | |
| 5,103,920 | A | 4/1992 | Patton | |
| 5,205,163 | A | 4/1993 | Sananikone | |
| 5,316,091 | A | 5/1994 | Rasi et al. | |
| 5,337,839 | A | 8/1994 | Warren et al. | |
| 5,358,059 | A | 10/1994 | Ho | |
| 5,390,748 | A | 2/1995 | Goldman | |
| 5,425,429 | A | 6/1995 | Thompson | |
| 5,467,832 | A | 11/1995 | Orban et al. | |
| 5,474,142 | A | 12/1995 | Bowden | |
| 5,513,710 | A | 5/1996 | Kuckes | |
| 5,551,286 | A | 9/1996 | Booer | |
| 5,713,422 | A | 2/1998 | Dhindsa | |
| 5,730,234 | A | 3/1998 | Putot | |
| 5,738,178 | A | 4/1998 | Williams et al. | |
| 5,803,185 | A | 9/1998 | Barr et al. | |
| 5,842,149 | A | 11/1998 | Harrell et al. | |
| 6,026,912 | A | 2/2000 | King et al. | |
| 6,029,951 | A | 2/2000 | Guggari | |
| 6,050,348 | A | 4/2000 | Richarson et al. | |
| 6,065,332 | A | 5/2000 | Dominick | |
| 6,092,610 | A | 7/2000 | Kosmala et al. | |
| 6,152,246 | A | 11/2000 | King et al. | |
| 6,155,357 | A | 12/2000 | King et al. | |
| 6,192,998 | B1 | 2/2001 | Pinckard | |
| 6,293,356 | B1 | 9/2001 | King et al. | |
| 6,382,331 | B1 | 5/2002 | Pinckard | |
| 6,405,808 | B1 | 6/2002 | Edwards et al. | |
| 6,757,613 | B2 | 6/2004 | Chapman et al. | |
| 6,802,378 | B2 | 10/2004 | Haci et al. | |
| 6,820,702 | B2 | 11/2004 | Niedermayr et al. | |
| 6,892,812 | B2 | 5/2005 | Niedermayr et al. | |
| 7,000,710 | B1 | 2/2006 | Umbach | |
| 7,032,689 | B2 | 4/2006 | Goldman et al. | |
| 7,044,239 | B2 | 5/2006 | Pinckard et al. | |
| 7,059,427 | B2 | 6/2006 | Power et al. | |
| 7,085,696 | B2 | 8/2006 | King | |
| 7,096,979 | B2 | 8/2006 | Haci et al. | |
| 7,100,698 | B2 | 9/2006 | Kracik et al. | |
| 7,140,452 | B2 | 11/2006 | Hutchinson | |
| 7,243,735 | B2 | 7/2007 | Koederitz et al. | |
| 7,357,196 | B2 | 4/2008 | Goldman et al. | |
| 7,404,454 | B2 | 7/2008 | Hulick | |
| 7,419,012 | B2 | 9/2008 | Lynch | |
| 7,461,705 | B2 | 12/2008 | Hulick | |
| 7,543,658 | B2 | 6/2009 | Russell et al. | |
| 7,546,209 | B2 | 6/2009 | Williams | |
| 7,584,788 | B2 | 9/2009 | Baron et al. | |
| 7,588,099 | B2 | 9/2009 | Kracik | |
| 7,588,100 | B2 | 9/2009 | Hamilton | |
| 7,665,533 | B2 | 2/2010 | Hopwood et al. | |
| 7,775,297 | B2 | 8/2010 | Hopwood et al. | |
| 7,823,655 | B2 | 11/2010 | Boone et al. | |
| 7,860,593 | B2 | 12/2010 | Boone | |
| 7,938,197 | B2 | 5/2011 | Boone et al. | |
| 8,215,417 | B2 | 7/2012 | Annaiyappa et al. | |
| 8,510,081 | B2 | 8/2013 | Boone | |
| 2002/0104685 | A1 | 8/2002 | Pinckard et al. | |
| 2003/0024738 | A1 | 2/2003 | Schuh | |
| 2004/0028476 | A1 | 2/2004 | Payne et al. | |
| 2004/0118612 | A1* | 6/2004 | Haci et al. | 175/61 |
| 2004/0222023 | A1 | 11/2004 | Haci et al. | |
| 2004/0238222 | A1 | 12/2004 | Harrison | |
| 2006/0081399 | A1* | 4/2006 | Jones | 175/61 |
| 2006/0185899 | A1 | 8/2006 | Alft et al. | |
| 2006/0195307 | A1* | 8/2006 | Huang et al. | 703/7 |
| 2007/0175662 | A1* | 8/2007 | Kracik | 175/24 |
| 2007/0181343 | A1 | 8/2007 | Russell et al. | |
| 2007/0203651 | A1 | 8/2007 | Blanz et al. | |
| 2007/0256861 | A1 | 11/2007 | Hulick | |
| 2007/0256863 | A1* | 11/2007 | Hulick et al. | 175/55 |
| 2008/0156531 | A1 | 7/2008 | Boone et al. | |
| 2008/0173480 | A1 | 7/2008 | Annaiyappa et al. | |
| 2008/0281525 | A1 | 11/2008 | Boone | |
| 2009/0058674 | A1 | 3/2009 | Papouras et al. | |
| 2009/0065258 | A1* | 3/2009 | Hamilton | 175/61 |
| 2009/0078462 | A1 | 3/2009 | Boone et al. | |
| 2009/0090555 | A1 | 4/2009 | Boone et al. | |
| 2009/0159336 | A1 | 6/2009 | Boone | |
| 2009/0250264 | A1 | 10/2009 | Dupriest | |
| 2010/0082256 | A1 | 4/2010 | Mauldin et al. | |
| 2011/0024187 | A1 | 2/2011 | Boone et al. | |

FOREIGN PATENT DOCUMENTS

| | | |
|---|---|---|
| SU | 1668652 | 8/1991 |
| WO | WO 93/12318 | 6/1993 |
| WO | WO 2004/055325 | 7/2004 |
| WO | WO 2006/079847 | 8/2006 |
| WO | WO 2007/073430 | 6/2007 |
| WO | WO 2008/070829 | 12/2008 |
| WO | WO 2009/039448 | 3/2009 |
| WO | WO 2009/039453 | 3/2009 |

OTHER PUBLICATIONS

"40223705—Series Wildcat Services Pneumatic Automated Drilling System," available at http://www.nov.com/Drilling/Control_and_Advisiory_Systems/Drawworks_Control_Auto_Drilling/Auto_Drillers.aspx (last visited Oct. 8, 2009).

"Wildcat ADS Automated Drilling System," Product Brochure, National Oilwell Varco, Inc. (2006).

Bonner, et al., "Measurements at the Bit: A New Generation of MWD Tools," *Oilfield Review*, pp. 44-54, Apr./Jul. 1993.

Brett, et al., "Field Experiences with Computer-Controlled Drilling," *Society of Petroleum Engineers 20107*, presented at *Permian Basin Oil and Gas Recovery Conference*, Midland, TX (Mar. 8-9, 1990).

Brown, et al., "In-Time Data Delivery," *Oilfield Review*, 11(4): 34-55, http://www.slb.com/media/services/resources/oilfieldreview/ors99/win99/pages34_55.pdf (Winter 1999/2000).

Dupriest, Fred E., "Maximizing ROP With Real-Time Analysis of Digital Data and MSE" at the International Petroleum Technology Conference, Doha, Qatar, Nov. 21-23, 2005, pp. 1-8.

Dupriest, Fred E., et al., "Comprehensive Drill-Rate Management Process to Maximize Rate of Penetration" at SPE Annual Technical Conference and Exhibition, San Antonio, Texas, Sep. 24-27, 2006, pp. 1-9.

Dupriest, Fred E., et al., "Maximizing Drill Rates with Real-Time Surveillance of Mechanical Specific Energy" at SPE/IADC Drilling Conference 92194, Amsterdam, The Netherlands, Feb. 23-25, 2005, pp. 1-10.

Goldman, "Artificial Intelligence Applications Enhance Directional Control," *Petroleum Engineer International*, pp. 15-22, Feb. 1993.

Gurari, E., "CIS 680: Data Structures: Chapter 19: Backtracking Algorithms;" http://www.cse.ohio-state.edu/%7Egurari/course/cis680/cis680Ch19.html (1999).

Hartley, Frank, et al., "New Drilling Process Increases Rate of Penetration, Footage Per Day," in Offshore, vol. 66, Issue 1, Jan. 2006, pp. 1-5.

Jackson, et al., "Portable Top Drive Cuts Horizontal Drilling Costs," *World Oil Magazine*, vol. 214 Issue 11, pp. 81-89, Nov. 1993.

Leine, et al., "Stick-Slip Whirl Interaction in Drillstring Dynamics," *J. of Vibration and Acoustics*, 124: 209-220 (2002).

Maidla, Eric, et al., Understanding Torque: The Key to Slide-Drilling Directional Wells, International Association of Drilling Contractors, Society of Petroleum Engineers, paper selected for presentation by IADC/SPE Program Committee at the IADC/SPE Drilling Conference held in Dallas, TX, Mar. 2-4, 2004, IADC/SPE 87162.

Murch, "Application of Top Drive Drilling to Horizontal Wells," Society of Petroleum Engineers—SPE 37100, 1996.

(56) References Cited

OTHER PUBLICATIONS

Petroleum Extension Service, "Controlled Directional Drilling," N. Janicek (ed.), Third Edition, pp. 18-33 and 44-45, 1984.
Young, Jr., "Computerized Drilling Control," *Journal of Petroleum Technology*, 21(4): 483-96 (1969).
Roberto H. Tello Kragjcek et al., "Successful Application of New Sliding Technology for Horizontal Drilling in Saudi Arabia" Saudi Aramco Journal of Technology, Fall 2011, pp. 28-33.
International Search Report and Written Opinion issued for PCT/US2013/070970 dated Feb. 28, 2014, 14 pgs.

* cited by examiner where or

DRILL STRING OSCILLATION METHODS

BACKGROUND OF THE DISCLOSURE

Top drive systems are used to rotate a casing or a drill string within a wellbore. Some top drives include a quill that provides vertical float between the top drive and the tubular string, where the quill is usually threadedly connected to an upper end of the casing or drill pipe to transmit torque and rotary movement to the drill string, but can also be indirectly linked to the casing or drill pipe through a clamp, for example.

To reduce the incidence of binding and/or stick-slip, the top drive may be used to oscillate or rotationally rock the drill during drilling to reduce drag of the drill string in the wellbore. However, the parameters relating to the top-drive oscillation are typically programmed into the top drive system, may not be modified by an operator, and may not be optimal for every drilling situation. For example, the same oscillation parameters, such as speed, acceleration, and deceleration may be used regardless of whether the drill is string is relatively long, relatively short, and regardless of the sub-geological structure. However, oscillation parameters used in one drilling circumstance may be less effective in other different drilling circumstances. Because of this, in some instances, an optimal oscillation may not be achieved, resulting in relatively less efficient drilling and potentially less bit progression.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
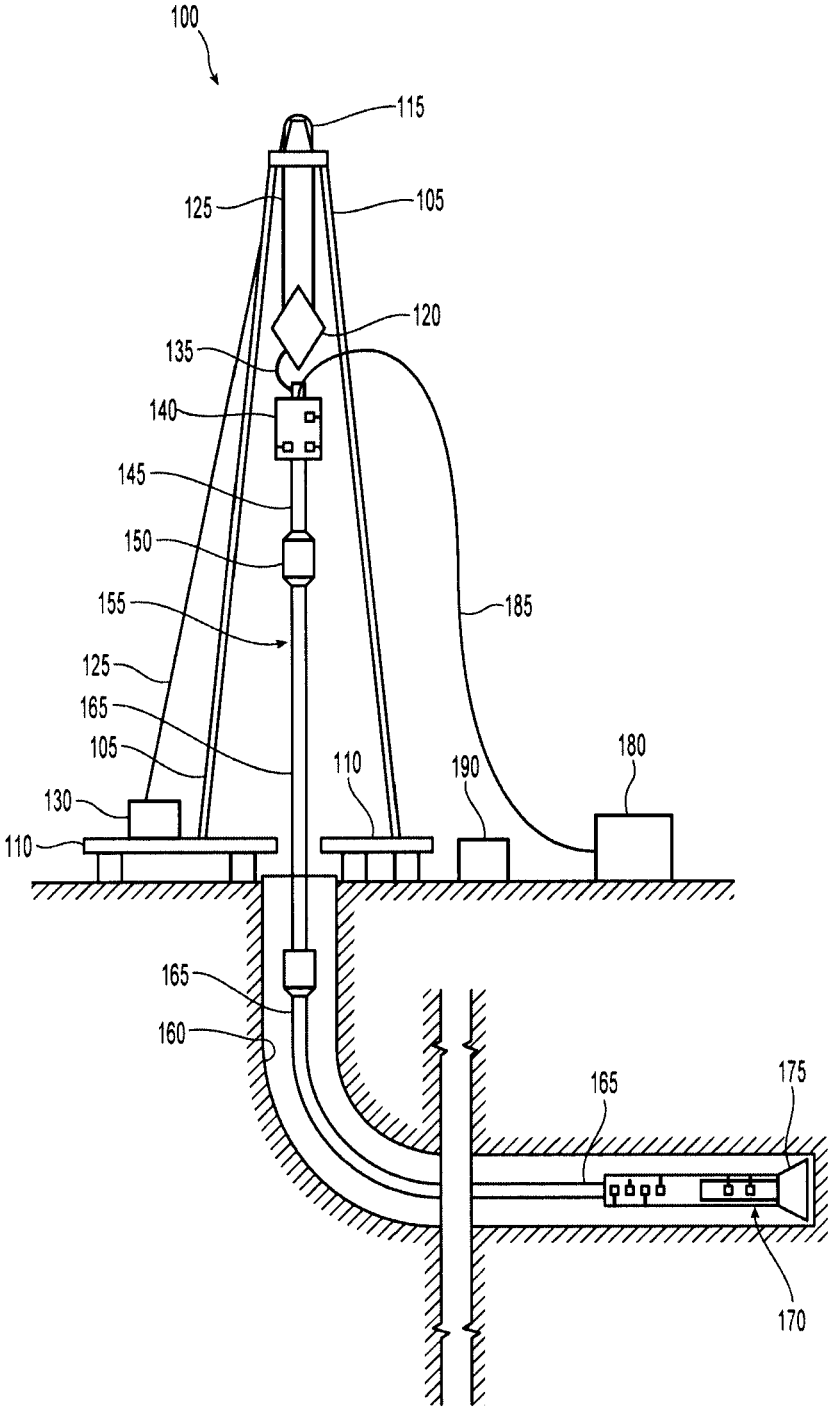
FIG. 1 is a schematic of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

This disclosure provides apparatuses, systems, and methods for enhanced directional steering control for a drilling assembly, such as a downhole assembly in a drilling operation. The apparatuses, systems, and methods allow a user (alternately referred to herein as an "operator") to modify an oscillating parameter to change a rocking technique to oscillate a tubular string in a manner that improves the drilling operation. By drilling or drill string, this term is generally also meant to include any tubular string. This improvement may manifest itself, for example, by increasing the drilling speed, penetration rate, the usable lifetime of component, and/or other improvements. In one aspect, the user may modify the oscillating parameters of the drilling assembly by modifying at least one of angular settings, speed settings, and acceleration and deceleration settings, typically to optimize the rate of penetration or another desired drilling parameter while minimizing or avoiding rotation of the bottom hole assembly.

In one aspect, this disclosure is directed to apparatuses, systems, and methods that optimize the oscillating parameters to provide more effective drilling. Drilling may be most effective when the drilling system is operated at optimized parameters. For example, a top drive angular setting that rotates only the upper half of the drill string will be less effective at reducing drag than a top drive angular setting that rotates the entire drill string. Therefore, an optimal angular setting may be one that rotates the entire drill string. Further, since excessive rotation might rotate the bottom hole assembly and undesirably change the drilling direction, the optimal angular setting would not adversely affect the drilling technique.

In one aspect, this disclosure is directed to apparatuses, systems, and methods of drilling that include modifying an acceleration profile to change the drilling effectiveness of the drilling system. The modified acceleration profile may be selected and controlled to identify the most effective, or optimized, rocking signature or technique. The apparatus and methods disclosed herein may be employed with any type of directional drilling system using a rocking technique, such as handheld oscillating drills, casing running tools, tunnel boring equipment, mining equipment, oilfield-based equipment such as those including top drives. The apparatus is further discussed below in connection with oilfield-based equipment, but the directional steering apparatus and methods of this disclosure may have applicability to a wide array of fields including those noted above.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. It should be understood that other conventional techniques for arranging a rig do not require a drilling line, and these are included in the scope of this disclosure. In another aspect (not shown), no quill is present.

The drill string 155 includes interconnected sections of drill pipe 165, a bottom hole assembly (BHA) 170, and a drill bit 175. The bottom hole assembly 170 may include stabilizers, drill collars, and/or measurement-while-drilling (MWD) or wireline conveyed instruments, among other components. The drill bit 175, which may also be referred to herein as a tool, is connected to the bottom of the BHA 170 or is otherwise attached to the drill string 155. One or more pump's 180 may deliver drilling fluid to the drill string 155 through a hose or other conduit 185, which may be fluidically and/or actually connected to the top drive 140.

In the exemplary embodiment depicted in FIG. 1, the top drive 140 is used to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 also includes a control system 190 configured to control or assist in the control of one or more components of the apparatus 100. For example, the control system 190 may be configured to transmit operational control signals to the drawworks 130, the top drive 140, the BHA 170 and/or the pump 180. The control system 190 may be a stand-alone component installed near the mast 105 and/or other components of the apparatus 100. In some embodiments, the control system 190 is physically displaced at a location separate and apart from the drilling rig.

Figure 2:
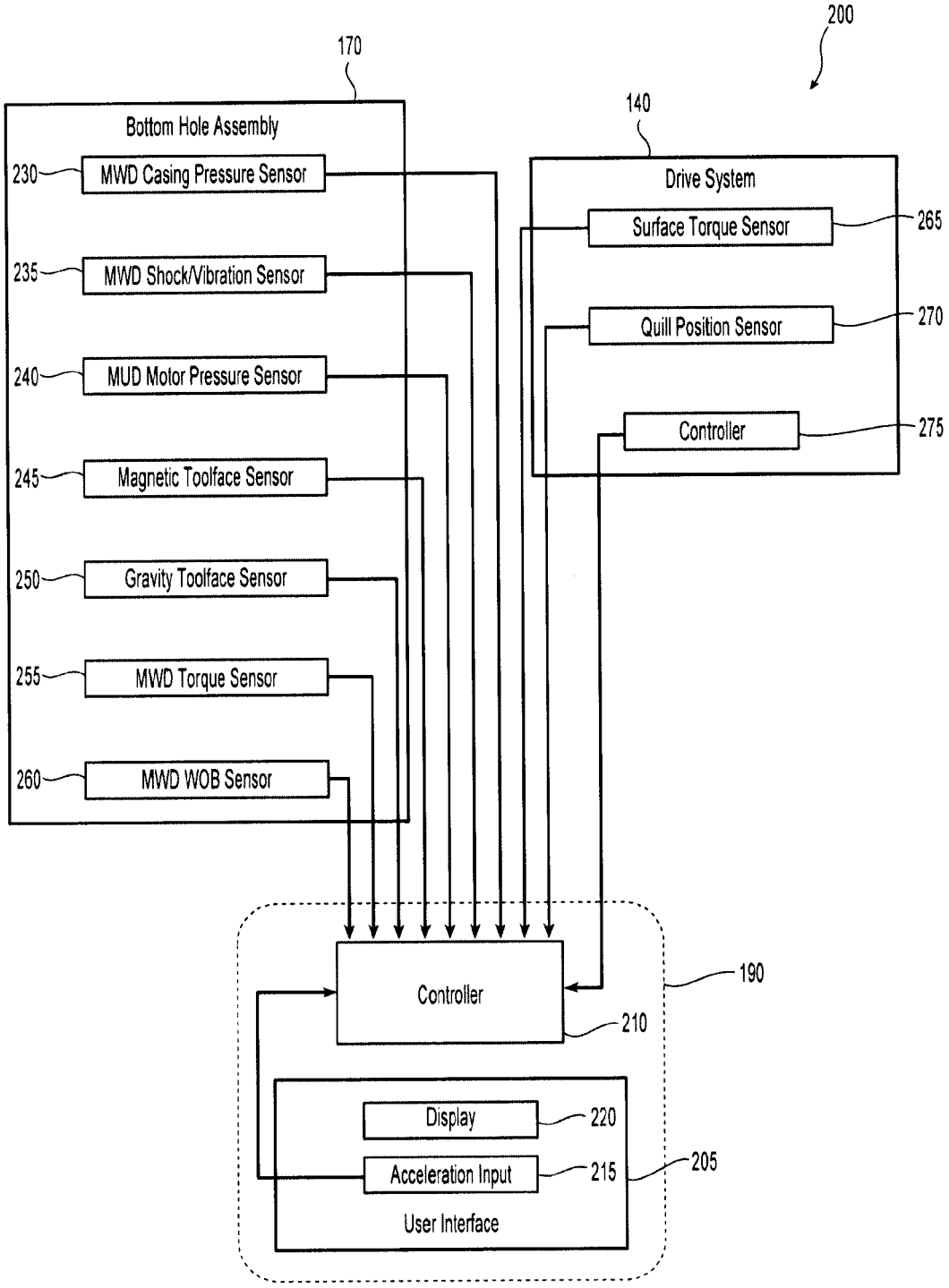
FIG. 2 is a schematic of an apparatus according to one or more aspects of the present disclosure.

FIG. 2 illustrates a block diagram of a portion of an apparatus 200 according to one or more aspects of the present disclosure. FIG. 2 shows the control system 190, the BHA 170, and the top drive 140. The apparatus 200 may be implemented within the environment and/or the apparatus shown in FIG. 1.

The control system 190 includes a user-interface 205 and a controller 210. Depending on the embodiment, these may be discrete components that are interconnected via wired or wireless means. Alternatively, the user-interface 205 and the controller 210 may be integral components of a single system.

The user-interface 205 includes an input mechanism 215 for user-input of one or more drilling settings or parameters, such as acceleration, toolface set points, rotation settings, and other set points or input data. The input mechanism 215 may include a keypad, voice-recognition apparatus, dial, button, switch, slide selector, toggle, joystick, mouse, data base and/or other conventional or future-developed data input device. Such an input mechanism 215 may support data input from local and/or remote locations. Alternatively, or additionally, the input mechanism 215 may permit user-selection of predetermined profiles, algorithms, set point values or ranges, such as via one or more drop-down menus. The data may also or alternatively be selected by the 210 via the execution of one or more database look-up procedures. In general, the input mechanism 215 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other means.

The user-interface 205 may also include a display 220 for visually presenting information to the user in textual, graphic, or video form. The display 220 may also be utilized by the user to input drilling parameters, limits, or set point data in conjunction with the input mechanism 215. For example, the input mechanism 215 may be integral to or otherwise communicably coupled with the display 220.

In one example, the controller 210 may include a plurality of pre-stored selectable acceleration profiles that may be viewed and selected by a user for operation of the top drive 140. The acceleration profiles may include the oscillating parameters for controlling the top drive 140 to operate at designated acceleration and deceleration rates and rotational speed settings within rotational limits. The selectable profiles may vary from each other to vary the rotational parameters of the top drive 140. By selecting a particular acceleration profile, the user may change the effectiveness of the overall drilling operation. Some acceleration profiles may be more effective than others in particular drilling scenarios. For example, when the drill string is relatively long, a first acceleration profile may result in a particular drill rate, such as a higher drilling rate. However, when the drill string is relatively short, the same particular acceleration profile may result in relatively lower drilling rate, while a second different acceleration profile may result in a relatively higher drilling rate. Likewise, when drilling through a particular type of geological formation, operating the top drive with a first acceleration profile may result in more effective drilling than operating the top drive with a second acceleration profile, while the second acceleration profile may result in more effective drilling than the first in a different type of geological formation. These acceleration profiles may have oscillating parameters that may be partially customizable by a user using the user-interface 205 to obtain optimal parameters. For example, the rotational speed setting may be substantially fixed, while the rotational settings of the top drive may be adjusted, thereby allowing a user to partially customize the acceleration profile by adjusting the rotational settings.

The BHA 170 may include one or more sensors, typically a plurality of sensors, located and configured about the BHA to detect parameters relating to the drilling environment, the BHA condition and orientation, and other information. In the embodiment shown in FIG. 3, the BHA 170 includes a MWD casing pressure sensor 230 that is configured to detect an annular pressure value or range at or near the MWD portion of the BHA 170. The casing pressure data detected via the MWD casing pressure sensor 230 may be sent via electronic signal to the controller 210 via wired or wireless transmission.

The BHA 170 may also include an MWD shock/vibration sensor 235 that is configured to detect shock and/or vibration in the MWD portion of the BHA 170. The shock/vibration data detected via the MWD shock/vibration sensor 235 may be sent via electronic signal to the controller 210 via wired or wireless transmission.

The BHA 170 may also include a mud motor AP sensor 240 that is configured to detect a pressure differential value or range across the mud motor of the BHA 170. The pressure differential data detected via the mud motor AP sensor 240 may be sent via electronic signal to the controller 210 via wired or wireless transmission. The mud motor AP may be alternatively or additionally calculated, detected, or otherwise determined at the surface, such as by calculating the difference between the surface standpipe pressure just off-bottom and pressure once the bit touches bottom and starts drilling and experiencing torque.

The BHA 170 may also include a magnetic toolface sensor 245 and a gravity toolface sensor 250 that are cooperatively configured to detect the current toolface. The magnetic toolface sensor 245 may be or include a conventional or future-developed magnetic toolface sensor which detects toolface orientation relative to magnetic north or true north. The gravity toolface sensor 250 may be or include a conventional or future-developed gravity toolface sensor which detects toolface orientation relative to the Earth's gravitational field. In an exemplary embodiment, the magnetic toolface sensor 245 may detect the current toolface when the end of the wellbore is less than about 7° from vertical, and the gravity toolface sensor 250 may detect the current toolface when the end of the wellbore is greater than about 7° from vertical. However, other toolface sensors may also be utilized within the scope of the present disclosure that may be more or less precise or have the same degree of precision, including non-magnetic toolface sensors and non-gravitational inclination sensors. In any case, the toolface orientation detected via the one or more toolface sensors (e.g., sensors 245 and/or 250) may be sent via electronic signal to the controller 210 via wired or wireless transmission.

The BHA 170 may also include an MWD torque sensor 255 that is configured to detect a value or range of values for torque applied to the bit by the motor(s) of the BHA 170. The torque data detected via the MWD torque sensor 255 may be sent via electronic signal to the controller 210 via wired or wireless transmission.

The BHA 170 may also include an MWD weight-on-bit (WOB) sensor 260 that is configured to detect a value or range of values for WOB at or near the BHA 170. The WOB data detected via the MWD WOB sensor 260 may be sent via electronic signal to the controller 210 via wired or wireless transmission.

The top drive 140 includes a surface torque sensor 265 that is configured to detect a value or range of the reactive torsion of the quill 145 or drill string 155. The top drive 140 also includes a quill position sensor 270 that is configured to detect a value or range of the rotational position of the quill, such as relative to true north or another stationary reference. The surface torsion and quill position data detected via sensors 265 and 270, respectively, may be sent via electronic signal to the controller 210 via wired or wireless transmission. In FIG. 2, the top drive 140 also includes a controller 275 and/or other means for controlling the rotational position, speed and direction of the quill 145 or other drill string component coupled to the top drive 140 (such as the quill 145 shown in FIG. 1). Depending on the embodiment, the controller 275 may be integral with or may form a part of the controller 210.

The controller 210 is configured to receive detected information (i.e., measured or calculated) from the user-interface 205, the BHA 170, and/or the top drive 140, and utilize such information to continuously, periodically, or otherwise operate to determine an operating parameter having improved effectiveness. The controller 210 may be further configured to generate a control signal, such as via intelligent adaptive control, and provide the control signal to the top drive 140 to adjust and/or maintain the BHA orientation.

Moreover, as in the exemplary embodiment depicted in FIG. 2, the controller 275 of the top drive 140 may be configured to generate and transmit a signal to the controller 210. Consequently, the controller 275 of the top drive 170 may be configured to influence the control of the BHA 170 to assist in obtaining and/or maintaining a desired acceleration profile. Consequently, the controller 275 of the top drive 140 may be configured to cooperate in obtaining and/or maintaining a desired toolface orientation. Such cooperation may be independent of control provided to or from the controller 210 and/or the BHA 170. In one example, the controller 275 may have a plurality of pre-stored, selectable acceleration profiles as described above with reference to the controller 210.

Figure 3:
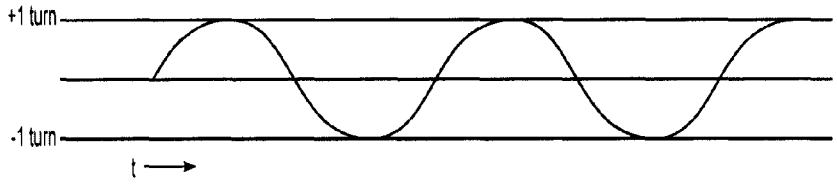
FIG. 3 is a diagram according to one or more aspects of the present disclosure.
Figure 4:
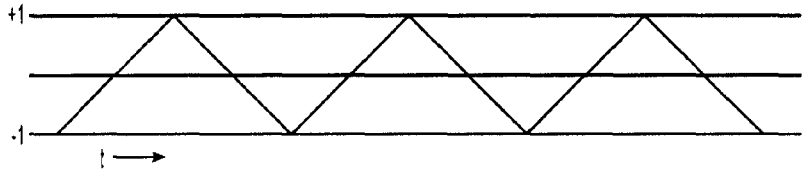
FIG. 4 is a diagram according to one or more aspects of the present disclosure.
Figure 5:
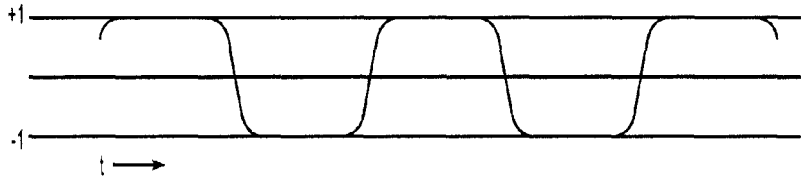
FIG. 5 is a diagram according to one or more aspects of the present disclosure.

FIGS. 3-5 show graphs of exemplary acceleration profiles that may be stored within one or both of the controllers 210, 275.

FIG. 3 for example shows a first exemplary acceleration profile as a relatively sinusoidal wave-form type. The acceleration profile represents the position of the top drive 140 as it rocks back and forth to rock or oscillate the drill string. It also represents the position of the rotating top drive over time. The top drive rotates in a first direction until an operational rotational setting is reached, and which point, the top drive 140 rotates in an opposite direction. For the sake of explanation, in the exemplary acceleration profile shown, the rotational settings are one turn in each direction from a neutral position, shown as a positive turn and shown as a negative turn over time. In FIG. 3, the top drive 140 follows an acceleration profile represented by a smooth increase in rotational speed, followed by a smooth decrease in rotational speed until the top drive stops and rotates in the opposite direction. In one example, the acceleration profile in FIG. 4 is a standard signature or default profile assigned by the controller 210 or the controller 275 shown in FIG. 3.

FIG. 4 shows an alternative, selectable acceleration profile that may provide a more aggressive rocking technique, and may result in a more aggressive cut. In this acceleration profile, the top drive 140 may rotate in one direction at a constant rate until the rotational limit is reached, and then the top drive may abruptly rotate in the opposite direction at a substantially constant rate. Accordingly, FIG. 4 shows a triangular wave-form type.

FIG. 5 shows a further alternative selectable acceleration profile that may provide an even more aggressive rocking acceleration profile. In FIG. 5, the rotational speed is relatively very fast as indicated by the substantially vertical lines of the acceleration curve. The top drive 140 may momentarily stop at each rotational limit before quickly accelerating to a relatively very high rotational speed within the safe operating limits of the top drive (or to minimize undue wear on the top drive) until the top drive is near the opposing rotational limit, at which point, it quickly decelerates to briefly stop at the rotational limit. Accordingly, FIG. 5 shows a stepped wave-form type.

Depending on the geological formation, the condition of the cutting bit, the length of the drill string, and other environmental factors, one type of acceleration profile may enable more effective drilling than other acceleration profiles. The method of FIG. 6 describes an exemplary method for identifying one or more effective acceleration profiles to optimize a drilling procedure, such as for example a rate of penetration, minimization or avoidance of stick-slip conditions while drilling, or the like, or a combination thereof.

Figure 6:
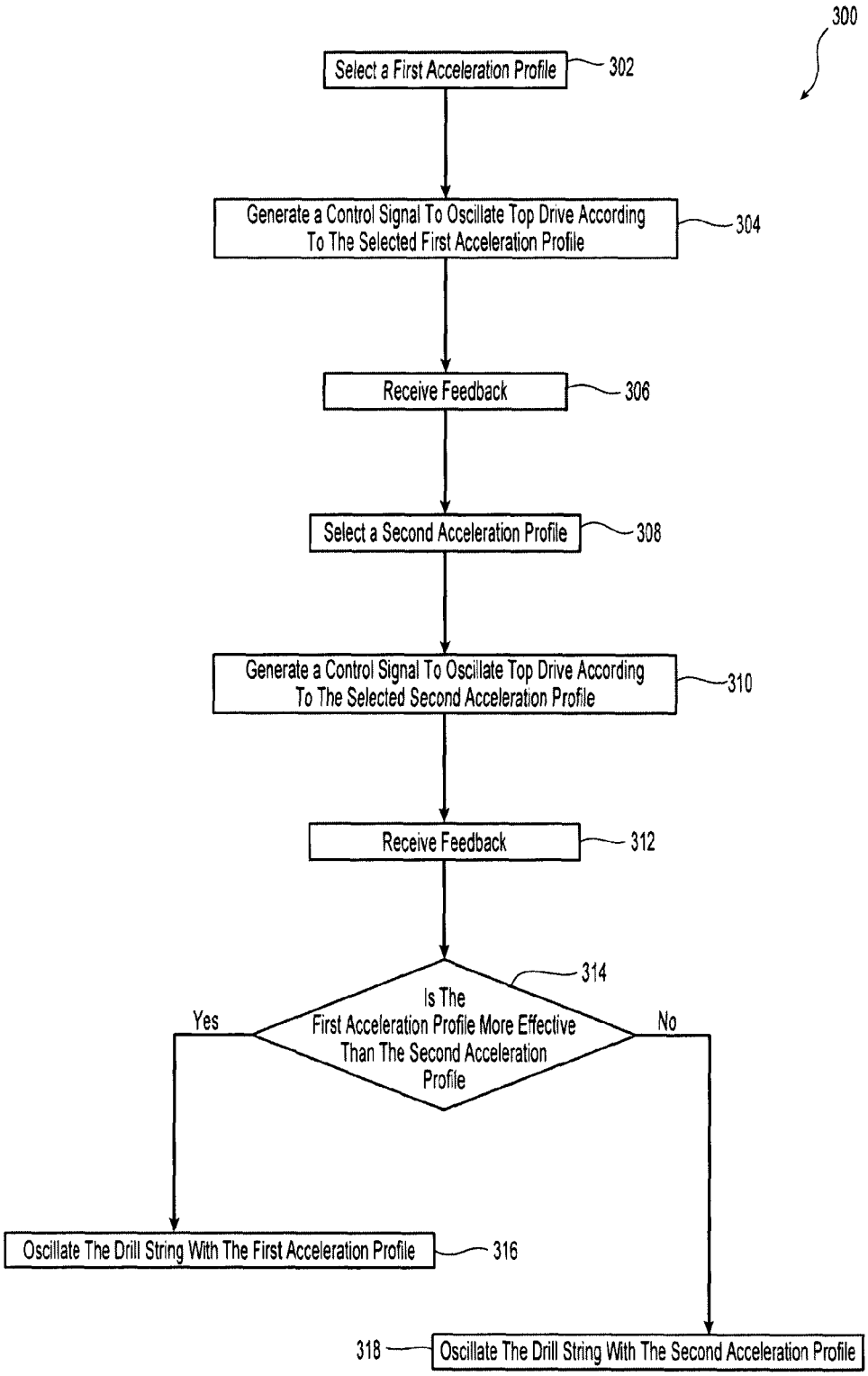
FIG. 6 is a flow-chart diagram of at least a portion of a method according to one or more aspects of the present disclosure.

FIG. 6 is a flow chart showing an exemplary method 300 of improving drilling effectiveness by modifying oscillating parameters of aspects of the drilling system 100. In the example in FIG. 3, the oscillating parameters are defined in the selectable acceleration profile, and may affect the drilling effectiveness, such as the drill speed or the penetration rate or other quantifiable measurement of effectiveness. The method begins at a step 302 where a user selects a first acceleration profile. The acceleration profile may be any of those exemplary acceleration profiles discussed above with reference to FIGS. 3-5, or may be other profiles.

In one embodiment, a user may select the first acceleration profile using the acceleration input 215 of the user-interface 205 in FIG. 2. The acceleration input 215 may communicate the selected acceleration profile to the controller 210, which may control the top drive 140 to oscillate the quill and drill string as selected. The controller 210 may communicate instructions regarding the selected acceleration profile to the controller 275 of the top drive 140. This acceleration profile may be selected from a listing of available, selectable acceleration profiles stored within the controller 210 as indicated above, or could be input by a user, or a combination thereof. In one embodiment, these profiles are presented to the user for selection. In another example, the control system 190 automatically selects the second acceleration profile. In this embodiment, the control system may scroll through two or more acceleration profiles, selecting the next one in line.

In some embodiments, the controller 210 may have an initial default acceleration profile, such as the standard signature profile in FIG. 3. In such an embodiment, the controller 210 itself may select the first acceleration profile. In other embodiments, the controller selects the profile when the controller 210 is initially powered on. Other embodiments require an actual user intervention at the acceleration input 215 on the user-interface 205 to select the acceleration profile.

In some embodiments, the first acceleration profile may be calculated or generated by the controller 210 based on current operating parameters of the drilling system. For example, the controller 210 may consider one or both of the length and diameter of the drill string to calculate a starting acceleration profile that may be close to suitable for the particular drill string parameters.

At a step 304, the controller 210 generates a control signal to oscillate the top drive 140 according to the selected acceleration profile. For example, if the exemplary acceleration profile in FIG. 3 were selected, the controller 210 would generate a control signal that operates the top drive according to oscillating parameters embodied in the acceleration profile in FIG. 3.

At a step 306, the controller 210 receives feedback regarding the effectiveness of the drilling operation utilizing at the selected first acceleration profile. In one embodiment, the controller 210 receives feedback from the surface torque sensor 265 of the top drive system 140. In another example, the controller 210 receives feedback from the BHA 170, such as one of the MWD casing pressure sensor 230, the MWD shock/vibrations sensor 235, the mud motor pressure sensor 240, the magnetic toolface sensor 245, the gravity toolface sensor 250, the MWD torque sensor 255, or the MWD WOB sensor 260, for example. Using this feedback, along with other feedback in some examples, the controller 210 may be configured to determine the effectiveness of the drilling operation with the first acceleration profile. For example, using the feedback, the controller 210 may be configured to determine drilling speed, penetration rate, loading applied to drilling components that may affect the useful life of the component, or other drilling parameters that may be an indication of relative effectiveness of the drilling operation.

At a step 308, the user or control system 190 selects a second acceleration profile that is different than the first acceleration profile selected in step 302. The second acceleration profile may be any of the exemplary profiles shown in FIGS. 3-5, or may be a different acceleration profile. In one embodiment, this selection is input into the control system at the acceleration input 215 of the user-interface 205. This acceleration profile may be selected from a listing of available, selectable acceleration profiles stored within the controller 210 or the controller 275. In one embodiment, these profiles are presented to the user for selection. In another example, the control system 190 automatically selects the second acceleration profile. In this embodiment, the control system 190 may scroll through two or more acceleration profiles, selecting the next one in line. In another example, the second acceleration profile is a modification of the first acceleration profile. For example, the user may use the acceleration input 215 to adjust one or more particular aspects of the first acceleration profile, such as the acceleration or deceleration rates, the angular settings, or the rotational speeds, for example. In another example, the operator may modify the wave-form type. Accordingly, in these instances, the user may create a second desired acceleration profile based on his or her experience and knowledge of drilling systems.

At a step 310, the controller 210 or 275 generates a control signal to oscillate the top drive 140 according to the second acceleration profile selected in step 308. At a step 312, the controller 210 receives feedback regarding the effectiveness of the drilling operation operating at the selected second acceleration profile in the manner discussed above with reference to step 306.

At a step 314, the controller compares the feedback obtained as a result of drilling with the first acceleration profile with the feedback obtained as a result of drilling with the second acceleration profile to determine whether the first acceleration profile was more effective than the second acceleration profile. As described above, effectiveness may be measured by, for example, increases in drilling speed, penetration rate, the usable lifetime of component, and/or other improvements. If the controller 210 determines that the first acceleration profile is more effective than the second acceleration profile, then the controller 210 operates the top drive 140 with the first acceleration profile as indicated at step 316. If the controller 210 determines that the first acceleration profile is not more effective than the second acceleration profile (or is less effective than the second acceleration profile), however, then the controller 210 operates the top drive with the second acceleration profile as indicated at step 318. The controller 210 may make the selection based on its comparison or alternatively, may present the data or a recommendation to the operator and wait for an operator input that selects the more effective acceleration profile.

Figure 7:
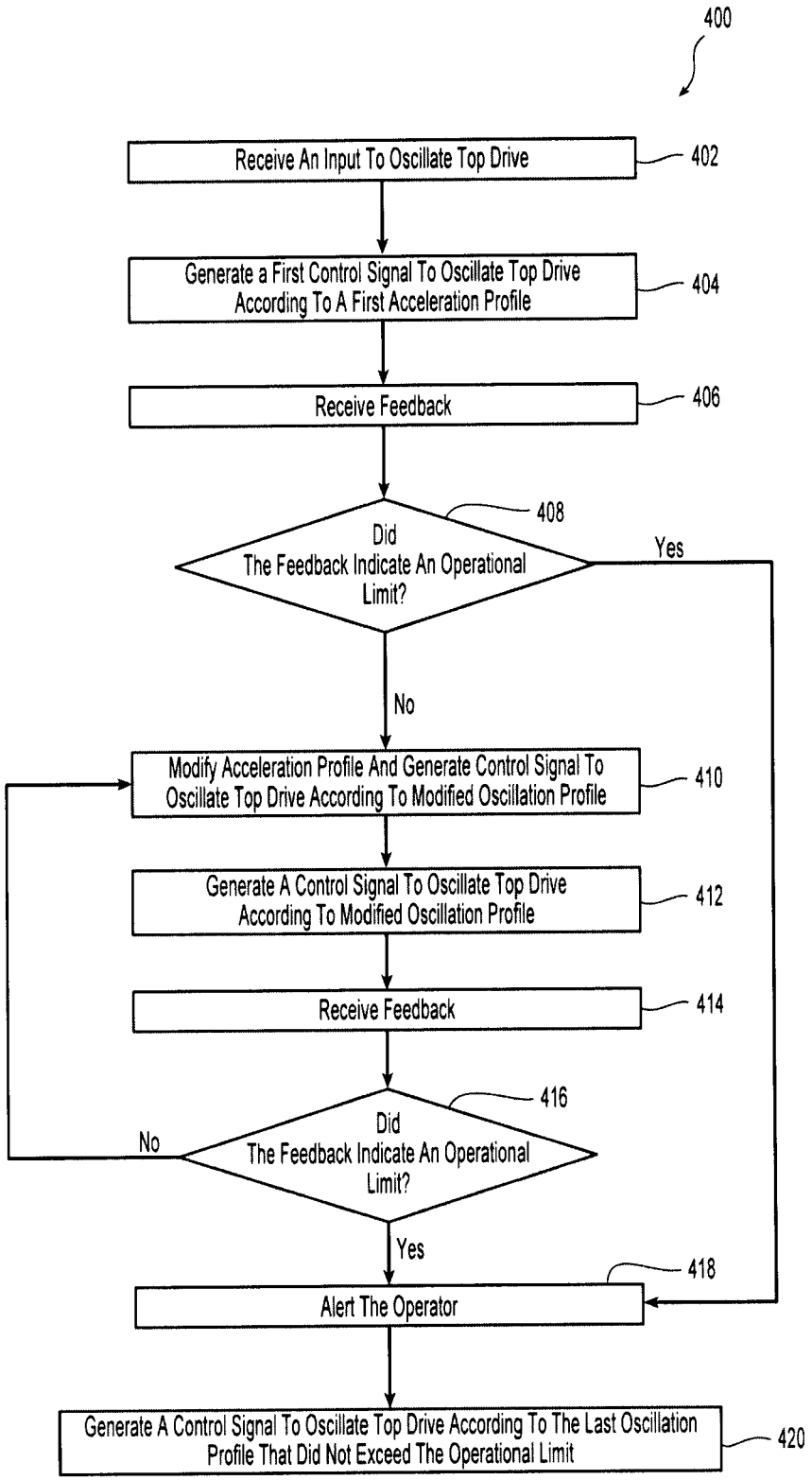
FIG. 7 is a flow-chart diagram of at least a portion of a method according to one or more aspects of the present disclosure.

FIG. 7 is a flow chart showing another exemplary method 400 of improving drilling effectiveness by optimizing oscillating parameters of the drilling system 100. In FIG. 7, the controller 210 receives an input to oscillate the top drive 140. In some embodiments, the controller 210 receives the input through the user-interface 205. In some embodiments, the input selects an acceleration profile from the plurality of pre-stored acceleration profiles. At a step 404, the controller 210 generates a first control signal to operate the top drive 140 according to the selected first acceleration profile in the manner discussed above at step 304. The system receives feedback at step 406 as discussed above.

At a step 408, the controller 210 determines whether the feedback indicates that the drilling system was operating at an operational limit. The system is operating at the an operational limit if the oscillating parameters are operating at or near maximum levels without adversely affecting the operational effectiveness of the drilling system. For example, the oscillating parameters may be optimized when the maximum cutting or depth penetration is obtained without affecting the toolface orientation or the drilling course of the BHA.

If at step 408, the feedback based on operation at the first acceleration profile indicates that the drilling system has reached an operational limit, that is, if the feedback determined that the first acceleration profile was providing maximum drilling effectiveness without an adverse effect on the drilling system, then the system may determine that the oscillating parameters are optimized. If the feedback indicates the acceleration profile corresponds to the operational limit, then the method proceeds to a step 418, and the controller alerts the operator that the system is operating at the optimal oscillating parameters.

If at step 408, the feedback indicates that the drilling system has not reached an operational limit, that is, if the feedback did not indicate an adverse effect on the drilling system from the selected acceleration profile, then the controller 210 may modify the acceleration profile to change the oscillating parameters at as step 410 in an effort to optimize the oscillating parameters by moving closer to the operational limit.

In one aspect, if the top drive 140 rotates to an angular setting, such as one revolution, and there is no feedback indicating that additional rotation would not be beneficial to the overall effectiveness of the drilling operation, then the controller 210 may rotate the top drive 140 an additional rotation in the same direction in an effort to identify the operational limit, and thereby identify the optimal rotational parameter for the drilling system. Thus, in one aspect, an iterative approach to achieve an optimal drilling parameter such as rate of penetration (ROP) may be pursued using different acceleration profiles in series while minimizing or avoiding undesired modification of the toolface orientation while drilling.

Accordingly, at step 410, the controller 210 may modify the acceleration profile in an effort to optimize the oscillating parameters. Some examples of modifying the acceleration profile include for example, modifying the oscillating parameter of the angular rotation, modifying the acceleration rates, modifying the rotational speeds, and modifying other oscillating parameters. For example, the acceleration profiles in FIGS. 3-5 include consistent angular rotation limits (as one revolution), but different acceleration profiles and different rotation speeds as indicated by their different wave-form types. Some methods include modifying the acceleration profile by incrementally adjusting one of the oscillating parameters of the acceleration profile. For example, it may include incrementally increasing or decreasing the rotational settings, incrementally increasing or decreasing the rotation acceleration or deceleration or the rotation speeds. In one embodiment, the user inputs modify the acceleration profile by indicating which setting to adjust and by indicating the amount or size of the adjustment.

At a step 412, the controller 210 may generate a control signal to oscillate the top drive according to the modified acceleration profile. At a step 414, the controller 210 receives the feedback as discussed above. At a step 416, the controller 210 may again evaluate the feedback to indicate whether the drilling system is operating at an operational limit. If information indicating an operational limit has not been met, the method returns to step 410. If an operational limit has been met, the method advances to step 418, and the operator is notified. Notifying the operator provides the operator with useful knowledge enabling him or her to make adjustments to the drilling system, including the acceleration profile, to operate the top drive at a particular operation settings.

At a step 420, the controller 210 generates a control signal to the top drive 140 to oscillate the top drive according to the last oscillation profile that did not exceed the operational limit. Accordingly, the controller 210 may operate the top drive at the optimal settings that do not adversely affect the drilling system.

Figure 8:
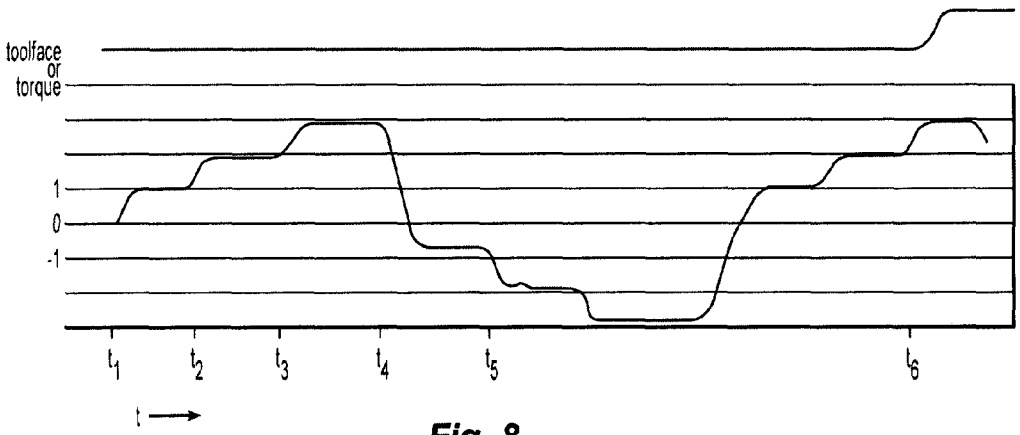
FIG. 8 is a diagram according to one or more aspects of the present disclosure.

The graphs in FIG. 8 may be used to further describe the method shown and described with reference to FIG. 7. FIG. 8 shows a first graph indicating the position of the rotating top drive 140 and a second graph indicating the position or alignment of the toolface or torque as detected at the BHA 170. At a time t1 in FIG. 8, the controller 210 may generate a first signal according to a first acceleration profile to rotate the drill string with the top drive 140 one revolution in the positive direction, corresponding to step 404 in FIG. 7. During the time between t1 and t2, the controller 210 may receive and evaluate feedback, corresponding to step 406. As can be seen in FIG. 8, the toolface or torque did not change as a result of rocking the drill string with the top drive at time t1. Accordingly, at time t2, the controller 210 may modify the acceleration profile to include a second revolution in the positive direction, as shown at step 410 in FIG. 7. As described above, the user may select which parameter to modify and the size or incremental step of the medication. Again, between time t2 and t3, the controller 210 may receive feedback from the BHA 170 or the top drive. In this case, FIG. 8 indicates there was still no impact on the toolface or torque on the BHA 170 as indicated by the flat line at time t3. Therefore, at step 416 in FIG. 7, the method returns to step 410. Further modifications to the acceleration profile occur at step 410. The time t4, the controller 210 directs the top drive 140 to rotate in the opposite direction according to the acceleration profile to a setting of one negative rotation. The top drive 140 continues to operate as described above.

At time t6 in the graph of FIG. 8, the feedback from the BHA 170 provides an indication that the oscillation has resulted in a rotation of the toolface or torque. Since the feedback indicates that an operational limit was exceeded, the controller 210 may alert the operator as indicated at step 418 and may set the oscillating parameter to correspond with the optimized parameters. According, the controller 210 continues to monitor feedback to determine the proper parameters or settings that provide an optimum rocking profile.

In view of all of the above and the figures, one of ordinary skill in the art will readily recognize that the present disclosure introduces a method, comprising oscillating, with a first acceleration profile, at least a portion of a drill string using a top drive at least indirectly coupled to the drill string, and oscillating, with a second acceleration profile different from the first acceleration profile, at least a portion of the drill string using the top drive. The method includes oscillating, with a third acceleration profile, at least a portion of the drill string using the top drive, wherein the third acceleration profile is optimized based on feedback associated with the oscillation with the first acceleration profile and feedback associated with the oscillation with the second acceleration profile. In an aspect, the method further comprises, prior to oscillating with the second acceleration profile, selecting the second acceleration profile based on input received from a human operator. In an aspect, selecting the second acceleration profile comprises selecting the second acceleration profile from a plurality of preset acceleration profiles stored in a controller associated with the top drive. In an aspect, selecting the second acceleration profile comprises selecting a modification of the first acceleration profile based on the input received from the human operator, wherein the modification modifies a first acceleration value of the first acceleration profile. In an aspect, the feedback associated with at least one of the first and second acceleration profiles is based on data received from at least one of the top drive and a bottom hole assembly coupled to the drill string. In an aspect, the feedback associated with at least one of the first and second acceleration profiles relates to a rate of penetration of a bit coupled to an end of the drill string. In an aspect, the feedback associated with at least one of the first and second acceleration profiles relates to a toolface orientation of a bit coupled to an end of the drill string. In an aspect, the feedback associated with at least one of the first and second acceleration profiles relates to torque data received from at least one of the top drive and a bottom hole assembly coupled to the drill string. In an aspect, the first acceleration profile includes a wave form type selected from a group consisting of: sinusoidal, stepped, triangular and a combination thereof. In an aspect, the second acceleration profile includes the same wave form type as the first acceleration profile and has a different acceleration value.

The present disclosure also introduces a method, comprising: generating a control signal for a top drive to oscillate at least a portion of a drill string based on first oscillating parameters, wherein the first oscillating parameters comprise at least an acceleration rate, an angular limit and a speed limit; receiving feedback from a bottom hole assembly coupled to the drill string that indicates that oscillation of at least a portion of the drill string based on the first oscillating parameters did not change a toolface orientation at an opposite end of the drill string from the top drive; incrementally modifying at least one of the first oscillating parameters and modifying the control signal based on the modified oscillating parameters; receiving feedback from the bottom hole assembly that indicates that oscillation of at least a portion of the drill string based on the modified oscillating parameters changed the toolface orientation; and further modifying the control signal to oscillate at least a portion of the drill string based on a set of optimized oscillating parameters set at levels below the modified oscillating parameters. In an aspect, further modifying the control signal to oscillate at least a portion of the drill string based on the optimized oscillating parameters comprises setting the parameters equal to the first oscillating parameters. In an aspect, incrementally modifying at least one of the first oscillating parameters comprises modifying the acceleration rate. In an aspect, the method further comprises receiving an operator input that incrementally adjusts one of the first oscillating parameters. In an aspect, the operator input determines which of the first oscillating parameters is to be incrementally adjusted. In an aspect, the operator input indicates the size of the incremental adjustment. In an aspect, incrementally modifying at least one of the first oscillating parameters comprises incrementally increasing both the acceleration rate and the speed limit. In an aspect, the method further comprises basing the first control signal at least in part on a diameter and a length of the drill string. In an aspect, incrementally modifying at least one of the first oscillating parameters occurs after receiving feedback from the bottom hole assembly that indicates that oscillation of at least a portion of the drill string based on the first oscillating parameters did not change the toolface orientation. In an aspect, incrementally modifying at least one of the first oscillating parameters comprises modifying an acceleration waveform type.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. A method, comprising:

oscillating, with a first acceleration profile, at least a portion of a drill string using a top drive coupled to the drill string, the first acceleration profile comprising pre-stored oscillation parameters including a first acceleration having a first wave form type defined by a first wave shape selected from a group consisting of: sinusoidal, stepped, and triangular;

oscillating, with a second acceleration profile different from the first acceleration profile, at least a portion of the drill string using the top drive, the second acceleration profile comprising pre-stored oscillation parameters including a second acceleration having a second wave form type defined by a second wave shape of the second wave form, the second wave shape selected from a group consisting of: sinusoidal, stepped, triangular, and a transition between any one of the sinusoidal, stepped, and triangular wave shapes relative to the first wave shape, the second wave shape defining the second wave form type being different than the first wave shape defining the first wave form type; and oscillating, with a third acceleration profile, at least a portion of the drill string using the top drive, wherein the third acceleration profile is optimized based on the feedback data obtained while oscillating with the first acceleration profile and feedback data obtained while oscillating with the second acceleration profile.

2. The method of claim 1 further comprising, prior to oscillating with the second acceleration profile, selecting the second acceleration profile based on input received from a human operator.

3. The method of claim 2 wherein selecting the second acceleration profile comprises selecting the second acceleration profile from a plurality of preset acceleration profiles stored in a controller associated with the top drive.

4. The method of claim 2 wherein selecting the second acceleration profile comprises selecting a modification of the first acceleration profile based on the input received from the human operator, wherein the modification modifies a first acceleration value of the first acceleration profile.

5. The method of claim 1 wherein the feedback associated with at least one of the first and second acceleration profiles is based on data received from at least one of the top drive and a bottom hole assembly coupled to the drill string.

6. The method of claim 1 wherein the feedback associated with at least one of the first and second acceleration profiles relates to a rate of penetration of a bit coupled to an end of the drill string.

7. The method of claim 1 wherein the feedback associated with at least one of the first and second acceleration profiles relates to a toolface orientation of a bit coupled to an end of the drill string.

8. The method of claim 1 wherein the feedback associated with at least one of the first and second acceleration profiles relates to torque data received from at least one of the top drive and a bottom hole assembly coupled to the drill string.

9. A method, comprising:

generating a control signal for a top drive to oscillate at least a portion of a drill string based on first oscillating parameters, wherein the first oscillating parameters comprise an acceleration rate, an angular limit, and a speed limit;

receiving feedback data from a bottom hole assembly coupled to the drill string that indicates that oscillation of at least a portion of the drill string based on the first oscillating parameters did not change a toolface orientation at an opposite end of the drill string from the top drive;

in response to the feedback data that indicates that the oscillation did not change the toolface orientation, incrementally modifying at least one of the first oscillating parameters and modifying the control signal based on the modified oscillating parameters;

receiving feedback from the bottom hole assembly that indicates that oscillation of at least a portion of the drill string based on the modified oscillating parameters changed the toolface orientation; and in response to the feedback data that indicates that the oscillation changed the toolface orientation, further modifying the control signal to oscillate at least a portion of the drill string based on a set of optimized oscillating parameters that include at least one of a new acceleration rate, a new angular limit, and a new speed limit, with said one of the new acceleration rate, the new angular limit, and the new speed limit having a value less than the corresponding value of said modified oscillating parameters.

10. The method of claim 9 wherein further modifying the control signal to oscillate at least a portion of the drill string based on the optimized oscillating parameters comprises setting the parameters equal to the first oscillating parameters.

11. The method of claim 9 wherein incrementally modifying at least one of the first oscillating parameters comprises modifying the acceleration rate.

12. The method of claim 9 further comprising receiving an operator input that incrementally adjusts one of the first oscillating parameters.

13. The method of claim 12 wherein the operator input selects only one of the first oscillating parameters for incremental adjustment.

14. The method of claim 12 comprising receiving an operator input specifying an amount of the incremental adjustment of said one of the first oscillating parameters.

15. The method of claim 9 wherein incrementally modifying at least one of the first oscillating parameters comprises incrementally increasing both the acceleration rate and the speed limit.

16. The method of claim 9 further comprising basing the first control signal at least in part on a diameter and a length of the drill string.

17. The method of claim 9 wherein incrementally modifying at least one of the first oscillating parameters occurs after receiving feedback from the bottom hole assembly that indicates that oscillation of at least a portion of the drill string based on the first oscillating parameters did not change the toolface orientation.

18. The method of claim 9 wherein incrementally modifying at least one of the first oscillating parameters comprises modifying the acceleration rate.

* * * * *